US007676867B2

(12) United States Patent
De Laura

(10) Patent No.: US 7,676,867 B2
(45) Date of Patent: Mar. 16, 2010

(54) RESTRICTION-FREE SUSPENDED FACE SUPPORT TREATMENT TABLE WITH HOLE DESIGNED TO ACCOMMODATE THE FACE OF A PERSON

(76) Inventor: Sharon Teresa De Laura, P.O. Box 1242, Sebastopol, CA (US) 95473

( * ) Notice: Subject to any disclaimer, the term of this patent is extended or adjusted under 35 U.S.C. 154(b) by 0 days.

(21) Appl. No.: 12/177,142

(22) Filed: Jul. 21, 2008

(65) Prior Publication Data

US 2008/0271248 A1 Nov. 6, 2008

(51) Int. Cl.
*A47C 20/02* (2006.01)
*A61G 13/12* (2006.01)

(52) U.S. Cl. ..... 5/622; 5/638; 5/725; 5/643

(58) Field of Classification Search ..... 5/622, 5/636–638, 640, 725, 643; 297/900
See application file for complete search history.

(56) References Cited

U.S. PATENT DOCUMENTS 3,114,527 A * 12/1963 Demarest ..... 248/118
3,403,413 A * 10/1968 Calhoun et al. ..... 5/638
5,337,429 A * 8/1994 Tucker ..... 5/643
5,926,871 A * 7/1999 Howard ..... 5/111
5,970,546 A * 10/1999 Danis ..... 5/636
6,397,414 B1 * 6/2002 Lloyd ..... 5/622
7,543,345 B2 * 6/2009 Wilson et al. ..... 5/638
7,574,759 B2 * 8/2009 Wilson et al. ..... 5/636

* cited by examiner

*Primary Examiner*—Michael Trettel
(74) *Attorney, Agent, or Firm*—Eric Hanscom; Todd Langford

(57) ABSTRACT

A restriction-free face support for health practitioner's tables designed for work on a prone person, comprising a plurality of optionally interconnected, adjustable support straps padded with memory foam designed to cradle the person's face over a headrest or cutout during a spa treatment, massage, chiropractic, or acupuncture sessions, or any other treatment involving a person lying face-down on a table. The face support allows for the person to rest and breathe comfortably and without the restrictive facial pulling/squeezing found in the prior art. The invention is simple, inexpensive, and can be built into massage tables or retrofitted onto existing tables, and the support straps are adjustable through use of buckles, hook-and-loop, or other means. Optionally, the support straps can have removable beads and other devices attached that allow for the device to put pressure on particular pressure points during the massage.

19 Claims, 3 Drawing Sheets

RESTRICTION-FREE SUSPENDED FACE SUPPORT TREATMENT TABLE WITH HOLE DESIGNED TO ACCOMMODATE THE FACE OF A PERSON

CROSS REFERENCE TO RELATED APPLICATIONS

None.

STATEMENT REGARDING FEDERALLY SPONSORED RESEARCH OR DEVELOPMENT

This invention was not federally sponsored.

BACKGROUND OF THE INVENTION

Field of the Invention

This invention relates to the general field of face supports, and more specifically, to a face support for health practitioner's tables designed for work on a person in a prone position, comprising a plurality of optionally interconnected, adjustable support straps padded with memory foam designed to cradle the person's face over a headrest or cutout in a health practitioner's table during a massage, chiropractic session, acupuncture, spa or salon treatment, or other service involving a person lying face down on a table. The face support allows for the person to rest comfortably and without the facial pulling and squeezing found in the prior art. The invention is simple, inexpensive, and can be built into massage tables or retrofitted onto existing tables, and the support straps are adjustable through use of buckles, hook-and-loop fasteners, soft rubber straps, or other means. Optionally, the support straps can have removable beads and other devices attached that allow for the device to push on desired pressure points during the massage.

Medical and health practitioners who perform their work on people in prone positions have been using tables for centuries. The most frequent types of such treatment known today are massage therapy, chiropractic, acupuncture, spa and salon treatments, although the invention can be used on any table with a hole in which a person's face is designed to lie.

Prior to the invention of the "headrest" or "cutout", persons lying face down had to turn their heads to the side during treatment, often resulting in stressing the neck, shoulders and upper back that in many cases were the areas which caused the person to seek treatment in the first place.

The term "cutout" refers to a hole, often elliptical in shape, cut into the surface of a practitioner's table, in a location where the person's face naturally rests. The person's face then is inserted into the cutout and there is no need to turn the person's head and twist the neck to receive treatment. A cutout alone, however, leads to uncomfortable pressure being applied from the top, sides, and bottom of the cutout, where the person's head is being supported. Indeed, having one's cheeks smeared against the cutout creates a feeling not unlike an involuntary face-lift every time a person receives treatment. Further, having a support structure on the forehead of the person often causes the person's neck to involuntarily bend backward. Again, since most persons who avail themselves of the tables of massage therapists, chiropractors, acupuncturists, or the like have neck or back problems; a table that causes the person to undergo additional stress to the very region that has been damaged can result in a treatment that is more detrimental than beneficial.

An additional problem is that some of the "pressure points" of a person's body are located on his or her face, particularly on the sides of the eyes, and the forehead, mouth, and cheek regions. For example, it is well known that for many people prone to seasickness, wearing an adjustable wrist strap with a hard bead that applies pressure to a certain portion of the inside wrist can severely decrease the likelihood that the person will become seasick. Unfortunately for health practitioners using the cutouts, there are pressure points found in the exact regions upon which some pressure is applied by the cutout, such as pressure points for the frontal sinus cavity, stomach, intestine, liver and kidney.

The "headrest" was an attempt to alleviate the problems caused by the cutout. The donut is an elliptically shaped tube with an easily cleaned exterior and a padded interior. The headrest is more comfortable than a mere cutout because it provides more padding and can be adjusted to fit faces of different shapes. The headrest, however, still puts pressure on the very same pressure points as the cutout and causes the same pull at the sides of the cheeks, where it rests, resulting in the same feeling that one's skin is being pulled taught across the face.

Thus, the problem remains of how to allow for a comfortable treatment of a person lying prone on a table with a hole cut into the surface, without adverse pressure on any pressure points, uncomfortable stretching of the facial skin, or any unhealthy bending of the neck or other body portions.

The prior art has several examples of attempts to resolve this problem. For example, U.S. Pat. No. 5,778,887 is a body support with two rigid beams and a padded forehead strap. This invention, however, fails to utilize means to prevent pressure upon pressure points and would cause the neck to bend as much of the person's weight is on the forehead support.

U.S. Pat. No. 6,128,797 provides a support cushion for face-down tanning or massage. The cushion is composed of inflatable plastic or rubber material, or solid foam material, and has an elongated recess for accommodating a person's face. Ventilation apertures extend from each side of the cushion and communicate with the recess to provide a constant fresh air supply. This invention is similar to the current invention in the fact that it is meant for the same purpose—to be used for massage tables and tanning, and anything that requires a prostrate positioning. However, it does not use straps to alleviate the facial pulling, or concern itself with facial pressure points. Rather, it is more similar to the prior art contraptions that the current invention has improved upon.

U.S. Pat. No. 6,374,441, to Begell, describes a cushioned headrest for a chiropractor's table having a substantially U-shaped configuration for receiving and supporting a user's head in a face-down orientation. The dense foam cushion is contoured to support the user's face by direct engagement with the user's face, decreasing the pressure particularly in the area of the frontal sinus and maxillary sinus cavity and facial bones, specifically the bony area around and under the eye. A central opening through the cushion, angled in from the contact locations, receives the nose and mouth portions of the user's face and permits free breathing. By using such facial contours, Begell claims that the headrest of the present invention increases the surface area of contact in specific areas of the face, while the person is in a prone position. The increased surface area decreases pressure to the sinus cavity and facial bone regions. At the same time, this invention relies upon cushioned pads on the face, thereby failing to alleviate the facial stretch the current invention prevents. The current invention can be retrofitted to existing donuts much more readily that this invention as well.

U.S. Pat. No. 6,487,736 describes a head support device that provides support and comfort for postoperative patients who are required to lie face down for a few days following surgery. The head support is wearable like a hat, has a removable liner, is cushioned to protect the head and eye, is adjustable to head size, is adjustable to height in use, is securely retainable on a user's head, and is adapted to prevent side to side rocking or tipping over. It includes straps and openings so the user can breathe and be supported while facing down. This invention serves a similar purpose in cradling the face while in the prostrate position, but it does not function to relieve pressure, nor does it remain attached to a bed or plank like object. While the '736 patent is designed to minimize certain pressures, the current invention avoids these pressures entirely by allowing the support straps to be adjusted such that they don't lie under the pressure points and sinus areas to be avoided. This invention is also not easily retrofitted to existing tables.

U.S. Pat. No. 6,694,551 teaches a facial support device having a frame and a cushion, or webbing, for supporting an individual's head, when the individual is reclining in a prone, face down position. The device of this invention is ergonomically designed to provide a gradual transition from the plane of an individual's reclining torso to his head, and thereby avoids or minimizes stresses to the cervical spine, and to the musculature of the neck and back. This device includes an asymmetric opening associated with its cushion or webbing to permit unrestricted breathing by an individual when reclining in a face down position. It is confusing how exactly the "webbing" is to be used, as "webbing" is given superficial mention (and no illustrations) in the patent. It appears that webbing is intended to serve the same purpose as the "elevated donut" created in FIG. 1, such that the webbing would create the elliptical hole, thereby creating the exact same problems as the rest of the prior art which relies upon solid supports to support the head (and inadvertently pull the sides of the face as the face settles into the hole).

U.S. Pat. No. 7,089,613, to Cohen, entitled "Flexing Head Support Suspension System," comprises a pressure sensitive apparatus for supporting the head, neck, and face. The apparatus includes a face plate and a suspension support unit. The suspension mechanism in the support unit maintains a neutral placement of the head in relation to the body while the subject is undergoing treatment. The apparatus alleviates discomfort and pain that often comes as a result of the pressure on the body during treatment of various somatic modalities. The apparatus may be a stand-alone unit or attachable to both standard and non-standard massage tables. It is unique in the fact that it is not a donut or U-shaped cushion; rather it offers support to the forehead and upper parts of the face as well as the shoulders and chest region. Therefore, it attempts to relieve the problem of pressure on the majority of the face, but still applies pressure at the sides of the face, thereby creating the same "involuntary face lift" created by most of the other prior art. It is also not easily retrofitted to existing tables and quite complicated (and therefore expensive and difficult to put together and adjust) compared with the current invention.

U.S. Pat. No. 7,089,941 relates generally to a face mask support for providing pressurized gas to a patient. The mask support may be connected to a full face mask or a nasal mask. The pressurized gas may be ambient air, oxygen or a mixture thereof. This invention is not strongly related to the current invention but does function as a mask with a similar name and parallel purpose to relieve pressure on the face.

U.S. Patent Application 2006/0265808 discloses a face cradle pillow that includes a headrest base section, a semi-circular contour or bowl, a neck support member, an adjustable headrest panel, and a rear pillow support member. The face cradle pillow provides a cloud-like comfort gently cradling and supporting the user's head. In actual use, the user's head is supported in the semi-circular bowl that prevents the user's face from physically contacting the sides of the pillow headrest base section, but again creating the strain on the side of the face that the current invention avoids.

U.S. Patent Application 2006/0290194 teaches a flexible headrest assembly with non-skid contact for a massage device. It comprises a U-shaped cushion with individual pads that prevent the person's face from resting wholly on the U-shaped cushion. The device appears to have the capacity for stretchable rib knit material that can be stretched along two axes to lend support to the person's face and reduce the contact and pressure placed on their face. It is, however, not easily retrofitted to an existing table and is relatively complex (and therefore, presumably expensive) as compared with the current invention's face cradle. FIG. 5 shows some straps, but it should be noted that the straps are not adjustable, and would "support" the face mainly at the edges—the very same places that most of the prior art uses, thereby resulting in the person's skin being pulled up at the edges of the face.

Thus there has existed a long-felt need for a face support that allows for a individual being treated in a prone position to rest comfortably and without the facial pulling and squeezing found with tables utilizing the cut-out or donut. The face support ideally should be simple, inexpensive, and can be built into massage tables or retrofitted onto existing tables, and the support bands are adjustable through use of buckles, snaps, hook-and-loop fasteners, or other means.

The current invention provides just such a solution by having a face cradle created from a series of optionally interwoven and/or interconnected adjustable straps padded with memory foam. The face cradle serves as a face support for persons who lie prone on tables used by health practitioners such as massage therapists, acupuncturists, chiropractors and others. The invention comprises a plurality of optionally interconnected and/or interwoven, adjustable support straps padded with memory foam designed to cradle the person's face over a headrest or cutout in a health practitioner's table during a massage, chiropractic session, acupuncture, or other service involving a person lying face down on a table. The face support allows for the person to rest comfortably and without the facial pulling and squeezing found in the prior art. The invention is simple, inexpensive, and can be built into massage tables or retrofitted onto existing tables, and the support straps are adjustable through use of buckles, hook-and-loop, or other means. Optionally, the support straps can have removable beads and other devices attached that allow for the device to push on pressure points during the massage.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

SUMMARY OF THE INVENTION

One of the unique features of the current invention is to provide a device by which a person who lies in a face down position on a table can do so comfortably, with no compression or restriction on a person's face.

The invention allows a person lying on such a table to have his or her face cradled by the straps, which are adjustably located so as to avoid negative pressure points. Previous systems/products attempting to solve the same problem require either a solid foam cushion that surrounds at least part of the face (until the face begins to slide down due to gravity against the supporting edges, at which point the "support" pulls at the sides of the person's face), are complex and expensive, place undue pressure on a person's neck, and/or cannot be easily retrofitted onto existing tables.

The current invention eliminates these requirements and problems. Instead, it provides a simple, inexpensive means by which a prone person can comfortably rest, which can be both built into new tables and easily retrofitted onto existing tables.

It is a principal object of the invention to provide a device that allows a person lying prone on a table with a hole cut into its surface to undergo treatment in a comfortable and non-restrictive manner.

It is another object of the invention to provide a device that can be adjusted to avoid pressure points on a person's face, where pressure on that pressure point is not desired.

It is also an object of the invention to provide a series of straps that can, optionally, be interconnected and/or interwoven, which can be lined with memory foam or another cushioning substance, which creates a face cradle upon which a person's face can rest without any pulling on the skin as is found in much of the prior art.

An additional object of the invention is to provide a face cradle that can, optionally, be made from a plurality of straps which are attached to the edge of a headrest or the cut-out of the table and meeting in the center of the hole through some means of connection that can tie together two or more different straps from each side of the invention that support the forehead and face portion of the person's head, and where a second strap can have a chin strap to allow the second strap to support the chin portion of the person's head, and where the two sections of straps can be, optionally, removably connected to each other.

It is an additional object of the invention to provide a face cradle that can be made inexpensively and is simple to manufacture, install, and use.

A further object of the invention is to provide a face cradle that can easily be either installed as part of the manufacturer's equipment in a new table, or retrofitted onto an existing table.

It is a final object of this invention to provide a face cradle with points of attachment for beads and other items that could apply pressure to a pressure point which the health practitioner using the invention feels would be beneficial to be pressurized as part of the treatment.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

BRIEF DESCRIPTION OF THE FIGURES

FIG. 2 is a bottom view of the device with an individual's face showing through.

DETAILED DESCRIPTION OF THE FIGURES

Figure 1:
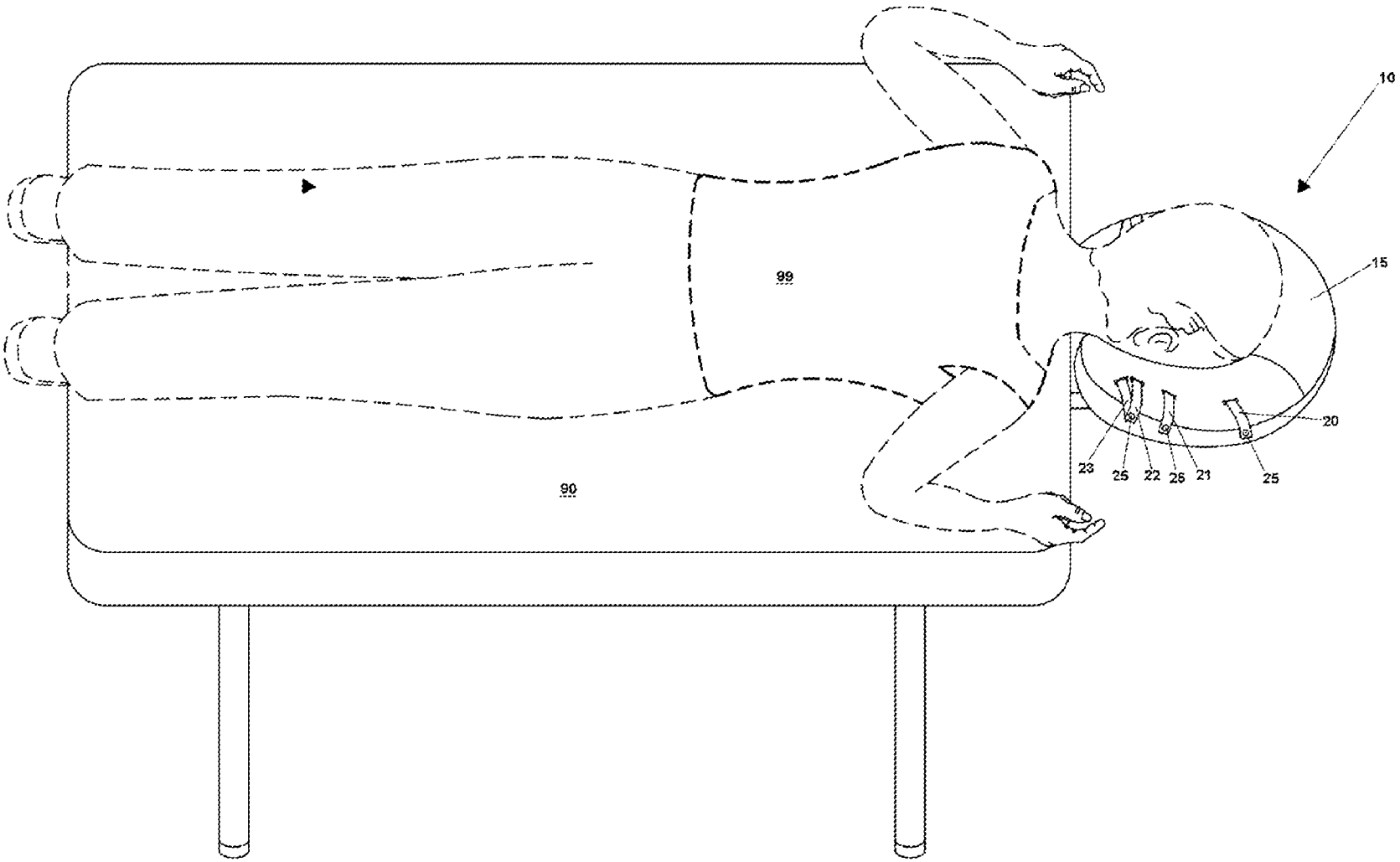
FIG. 1 is an illustration of one embodiment of the current invention, showing a person in a prone position on a table with a hole cut in the center.

Many aspects of the invention can be better understood with reference to the drawings below. The components in the drawings are not necessarily drawn to scale. Instead, emphasis is placed upon clearly illustrating the components of the present invention. Moreover, like reference numerals designate corresponding parts through the several views in the drawings.

Before explaining at least one embodiment of the invention, it is to be understood that the embodiments of the invention are not limited in their application to the details of construction and to the arrangement of the components set forth in the following description or illustrated in the drawings. The embodiments of the invention are capable of being practiced and carried out in various ways. In addition, the phraseology and terminology employed herein are for the purpose of description and should not be regarded as limiting, but rather as illustrative of embodiments of the invention.

FIG. 1 is an illustration of one embodiment of the current invention, showing a person in a prone position on a table with a hole cut in the center. A person 99 is shown resting face down on a table 90. The face cradle 10 of the current invention supports the person's head. The face cradle 10 includes a cushion 15, a cushion support (not shown in this figure), an upper forehead strap 20, a lower forehead strap 21, a cheek strap 22, and a chin strap 23. The straps support the face of the person 99. They are then fed through the cushion and appear on the top side to secure externally to the cushion 15. Each end of each strap includes a means of attachment 25.

Figure 2:
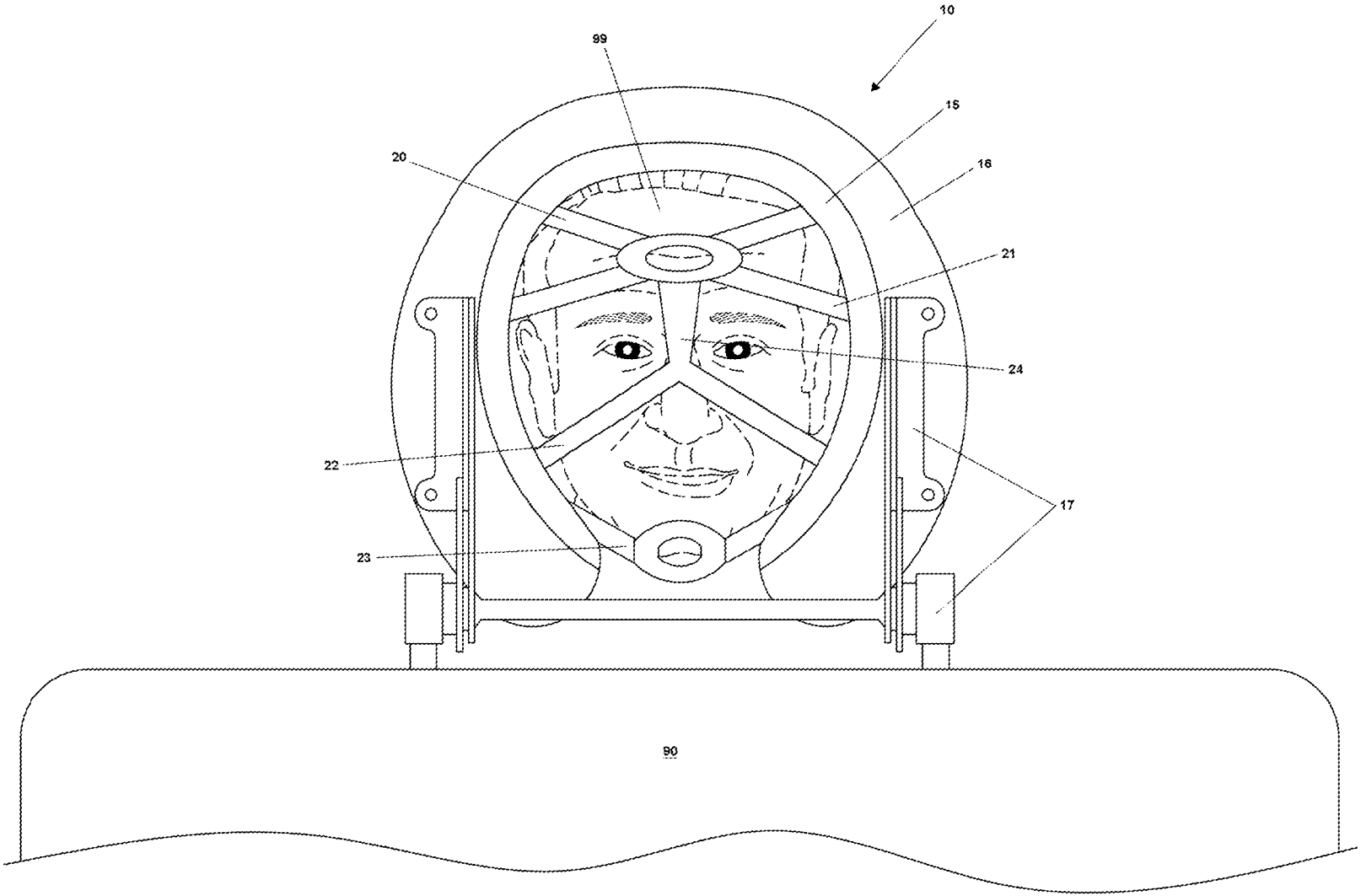

FIG. 2 is a bottom view of the device with an individual's face showing through. The person 99 is shown resting face down on a table 90. The face cradle 10 of the current invention supports the person's 99 head. The face cradle 10 includes a cushion 15, a cushion support 16, an upper forehead strap 20, a lower forehead strap 21, a cheek strap 22, and a chin strap 23. The straps support the face of the person 99 and are collectively known as support straps. They are then fed through the cushion and appear on the top side to secure externally to the cushion. The upper forehead strap 20 and the lower forehead strap can optionally connect together at the center of the forehead as shown in this figure. Further, a bridge strap 24 can connect the lower forehead strap 21 to the cheek strap 22. The face cradle 10 is connected to the table 90 by means of a table attachment 17. The table attachment 17 supports a cushion support 16, where the cushion support 16 supports the cushion 15 and the rest of the face cradle 10.

The placement of the straps is of particular importance to the invention. Applying pressure to certain pressure points should be avoided, and the current invention strives to support a person's face without unnecessarily applying pressure to these particular pressure points. The upper forehead strap 20 and the lower forehead strap 21 should both travel over the forehead. The lower forehead strap 21 should travel above the ears to avoid the pressure points for the circulatory system and nervous system. While two straps are shown traveling over the forehead, it may nonetheless be possible that one strap be used to achieve the same goal. The cheek strap 22 should travel over the nose, but as it leaves the face, it should travel beneath the ears towards the cushion 15 to avoid the pressure points for the lung and gall bladder. The chin strap 23 should travel around the jaw and support the chin. Preferably there is a an opening in the strap for the chin such that the jaw if comfortably supported without any undue pressure in any one location. A bridge strap can connect the lower forehead strap 21 and, optionally, the upper forehead strap 20 with the cheek strap 22 to keep these straps positioned in the correct locations on the face to avoid applying pressure to certain pressure points.

Figure 3:
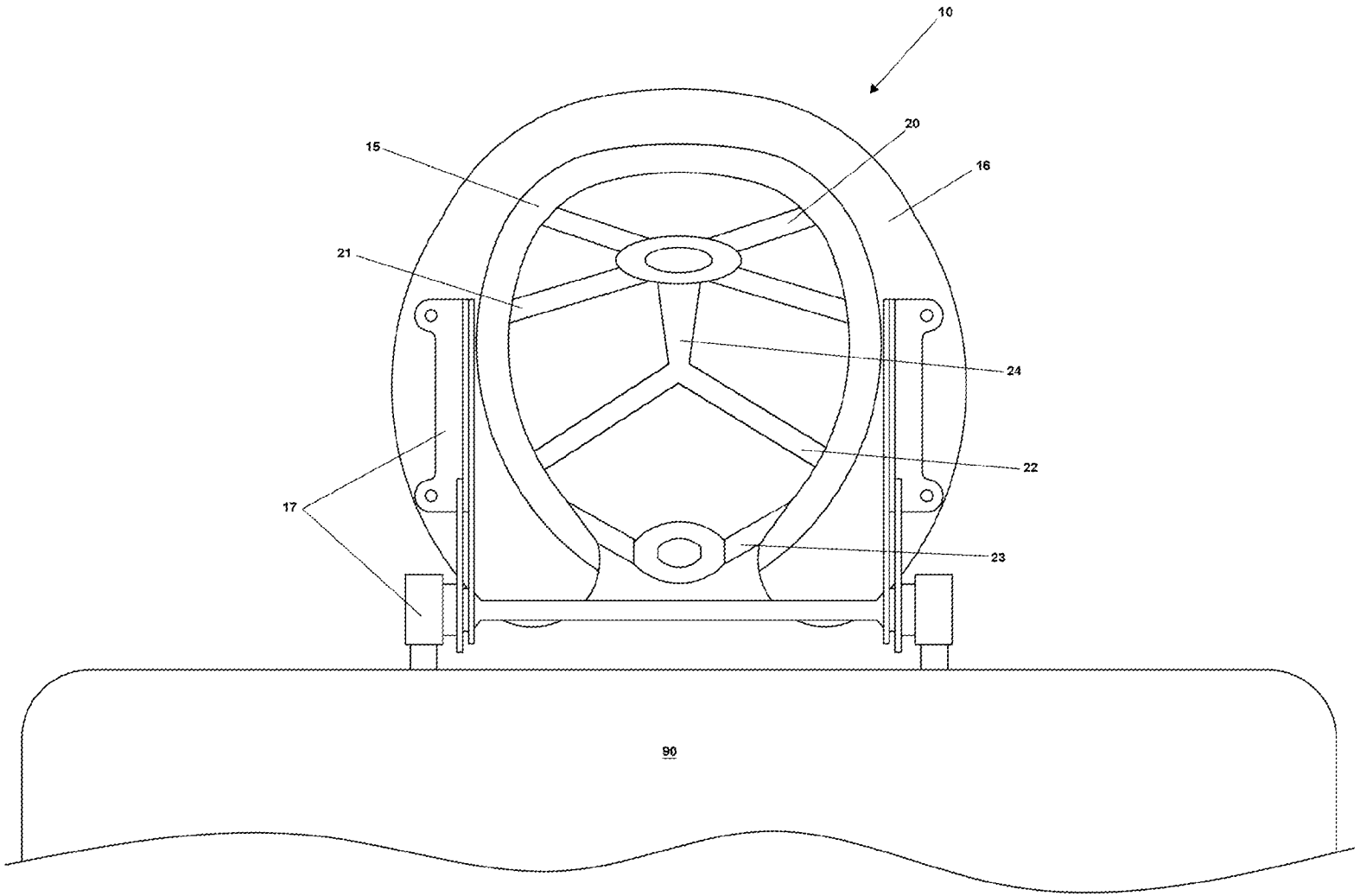
FIG. 3 is a bottom view of the device.

FIG. 3 is a bottom view of the device. The face cradle 10 includes a cushion 15, a cushion support 16, an upper forehead strap 20, a lower forehead strap 21, a cheek strap 22, and a chin strap 23. The straps support the face of the person 99. They are then fed through the cushion and appear on the top side to secure externally to the cushion. The upper forehead strap 20 and the lower forehead strap can optionally connect together as shown in this figure. Further, a bridge strap 24 can connect the lower forehead strap 21 to the cheek strap 22. The face cradle 10 is connected to the table 90 by means of a table attachment 17. The table attachment 17 supports a cushion support 16, where the cushion support 16 supports the cushion 15 and the rest of the face cradle 10.

The straps can also include a means of adjustment. The means of adjustment of each strap is used to custom fit the face cradle to an individual user. The adjustment/attachment components can take on a variety of embodiments. To attach and secure the straps to the cushion, a variety of means are contemplated. For example, snaps, buckles, hook-and-loop fasteners would all function, where one attachment portion was affixed to the cushion, and the mating attachment portions were affixed to the straps. The adjustment can be accomplished through a similar variety of means. Buckles are used to not only attach the straps to the cushion, but also to adjust the straps so that it allows a health practitioner to comfortably suspend the person's head above the hole in the table. One portion of the buckle is affixed to the side of the hole on the cushion, and the ends of the straps have holes drilled or punched in them such that each strap can be independently adjustably secured to its matching buckle. Alternative means of adjustment include snaps, where, for example, a male snap half is affixed to the side of the cushion, and the strap has a series of female snap halves such that the strap can be adjusted by selecting which female snap half to snap into the male snap half. The same result could also be obtained with hook-and-loop fasteners, magnets, and a wide variety of other known means of attachment.

It should also be noted that the means of attachment can be separate from the means of adjustment. For example, the means of attachment could be snaps and the means of adjustment could be buckles. A wide variety of combinations are possible, all of which are considered part of this invention.

While a preferred embodiment of this invention is a face cradle that can be used by either the manufacturer of tables or a health practitioner who decides to upgrade his/her tables to accommodate this invention, it is also contemplated that a personal version of the invention would be useful where a person who regularly gets treatments in a face-down, prone position, could be desirable. This personal version would have a means to clamp the face cradle to a table such that the person could bring his/her personal face cradle into a therapy session.

It is also contemplated that a wide variety of materials could be used for the straps. While a preferred embodiment uses leather or a firm, non-stretchy plastic for the support straps, alternative materials could include semi-elastic products, loosely woven natural products or comfortable straps well known in the art. The straps themselves can also include beads or other irregularities to apply pressure to particular pressure points, where a beneficial, pleasant, or medically desirable effect can be achieved by putting pressure on the pressure point. Memory foam can also be added to the straps, either along the entire length or at discreet locations, to add an additional level of comfort to the person while using the face cradle.

While four main straps have been disclosed in the application, a face cradle with fewer or more straps are possible without departing from the scope of the current invention. A single strap could be used across the forehead, especially if the strap were wider to disperse the pressure applied to the forehead. The current invention could also be utilized without the bridge strap and still achieve the same goal. Additional straps could be added; however, they should be positioned to avoid certain pressure points located on the face where putting pressure on said pressure points could produce a negative result.

The cushion of the present invention is preferably a U-shaped pillow-type cushion. Other cushions are contemplated by the inventor, including inflatable cushions and cushions that are donut-shaped. Alternatively the cushion could a part of the table itself.

The cushion is supported by a cushion support or a headrest. The cushion support is connected to a table attachment that connects the face cradle to a table, such as a massage table. The table attachment can include means to adjust the angle of the face cradle relative to the table and/or the distance between the face cradle and the table. Preferably, the table attachment can quickly secure to and release from the table such that existing tables can be retrofitted with the current invention; however, it is nonetheless contemplated by the inventor that the face cradle be permanently affixed, yet adjustable, to a table. Further, the face cradle could be integrated into a table, such that no table attachment is required. In this embodiment, there is a hole created in the table where the person's face fits through, and the straps are fed through and secured to the table cushion.

Although one embodiment of the face cradle has been shown herein, it is possible to come up with multiple variations without departing from the scope of the current invention. What is key to the current invention is that a person's face can be comfortably suspended and supported in a face cradle above the hole in a table without having undesirable pressure placed on the person's pressure points, thereby allowing the person to breathe easily and in a non-restricted manner, and to receive the benefits of the treatment.

I claim:

1. A face cradle for use with tables designed for individuals who lie on the table in a prone, face-down position, comprising:

a cushion, where the individual can place his or her head into the cushion such that his or her face is not covered by the cushion, a plurality of support straps, where the plurality of support straps support at least a portion of the individual's head, where the plurality of support straps travel over a portion of the face of the individual, and where the plurality of support straps do not travel over the ears, eyes, or mouth of the individual, a means to adjust the plurality of support straps, where the means to adjust the plurality of support straps adjusts the length of the plurality of support straps, and, a means to secure the plurality of support straps, where the means to secure the plurality of support straps secures the plurality of support straps to the cushion.

2. The face cradle of claim 1, where the plurality of support straps are interconnected.

3. The face cradle of claim 1, where the plurality of support straps support the face of the individual in a manner that does not exert a sideways pull on the face of the individual while the individual is lying down in a prone position.

4. The face cradle of claim 1, further comprising a table attachment, where the table attachment removably secures the face cradle to the table.

5. The face cradle of claim 1, further comprising a table attachment, where the table attachment permanently secures the face cradle to the table.

6. The face cradle of claim 1, where the face cradle is integrated into the table.

7. The face cradle of claim 1, where the means to adjust the plurality of support straps comprises buckles.

8. The face cradle of claim 1, where the means to adjust the plurality of support straps comprises hook-and-loop fasteners.

9. The face cradle of claim 1, where the plurality of support straps additionally comprise a means by which direct pressure may be applied to selected positive pressure points.

10. The face cradle of claim 1, where the plurality of support straps further comprise a layer of comfortable material, where the layer of comfortable material comprises memory foam.

11. A face cradle for use with tables designed for individuals who lie on the table in a prone, face-down position, comprising:

A cushion, where the individual can place his or her head into the cushion such that his or her face is not covered by the cushion, a forehead strap, where the forehead strap supports at least a portion of the head of the individual, where the forehead strap travels from one side of the cushion, above an ear of the individual, over the forehead, over the other ear, and then to the opposite side of the cushion, a cheek strap, where the cheek strap supports at least a portion of the head of the individual, where the cheek strap travels from one side of the cushion, below an ear of the individual, over the nose, below the other ear, and then to the opposite side of the cushion, a chin strap, where the chin strap supports at least a portion of the head of the individual, where the chin strap travels from one side of the cushion, over one side of the jaw of the individual, around the chin, over the other side of the jaw, and then to the opposite side of the cushion, where the forehead strap, cheek strap, and chin strap are collectively the support straps, where each support strap comprises a means to adjust the support strap, where the means to adjust the support strap adjusts the length of the support strap, and a means to secure the support strap, where the means to secure the support strap secures the support strap to the cushion.

12. The face cradle of claim 11, further comprising a bridge strap, where the bridge strap connects the forehead strap and the cheek strap together.

13. The face cradle of claim 11, further comprising a table attachment, where the table attachment secures the face cradle to the table.

14. The face cradle of claim 11, where the face cradle is integrated into the table.

15. A face cradle for use with tables designed for individuals who lie on the table in a prone, face-down position, comprising:

A cushion, where the individual can place his or her head into the cushion such that his or her face is not covered by the cushion, an upper forehead strap, where the upper forehead strap supports at least a portion of the head of the individual, where the upper forehead strap travels from one side of the cushion, above an ear of the individual, over the forehead, over the other ear, and then to the opposite side of the cushion, a lower forehead strap, where the lower forehead strap supports at least a portion of the head of the individual, where the lower forehead strap travels from one side of the cushion, above an ear of the individual, over the forehead, over the other ear, and then to the opposite side of the cushion, where the lower forehead strap is located closer to the bottom of the face than the upper forehead strap, a cheek strap, where the cheek strap supports at least a portion of the head of the individual, where the cheek strap travels from one side of the cushion, below an ear of the individual, over the nose, below the other ear, and then to the opposite side of the cushion, a chin strap, where the chin strap supports at least a portion of the head of the individual, where the chin strap travels from one side of the cushion, over one side of the jaw of the individual, around the chin, over the other side of the jaw, and then to the opposite side of the cushion, where the upper forehead strap, lower forehead strap, cheek strap, and chin strap are collectively the support straps, where each support strap comprises a means to adjust the support strap, where the means to adjust the support strap adjusts the length of the support strap, and a means to secure the support strap, where the means to secure the support strap secures the support strap to the cushion.

16. The face cradle of claim 15, where the upper forehead strap and the lower forehead strap connect together in the center of the forehead.

17. The face cradle of claim 16, further comprising a bridge strap, where the bridge strap connects the cheek strap to the lower forehead strap and upper forehead strap at the center of the forehead.

18. The face cradle of claim 15, further comprising a table attachment, where the table attachment secures the face cradle to the table.

19. The face cradle of claim 15, where the face cradle is integrated into the table.

* * * * *